United States Patent [19]

Alexander

[11] 3,968,525

[45] July 13, 1976

[54] ACTUATING MEANS FOR WATER CLOSET FLUSH TANK

[75] Inventor: Fred C. Alexander, New Castle, Pa.

[73] Assignee: Universal-Rundle Corporation, New Castle, Pa.

[22] Filed: Dec. 5, 1974

[21] Appl. No.: 529,720

[52] U.S. Cl. ..... 4/67 R; D23/66

[51] Int. Cl.[2] ..... E03D 1/012

[58] Field of Search ..... 4/18, 57 P, 67 R, 100, 4/249; 74/99 R, 479; 226/127–129; D23/66; 221/37

[56] References Cited

UNITED STATES PATENTS

| | | | |
|---|---|---|---|
| 2,290,006 | 7/1942 | Trollen | 221/37 |
| 2,436,679 | 2/1948 | Sprague | 4/67 R |
| 2,543,438 | 2/1951 | Cochran | 4/67 R |
| 3,173,153 | 3/1965 | Korol et al. | 4/67 R |
| 3,234,566 | 2/1966 | Rupp | 4/67 R |
| 3,736,212 | 5/1973 | Fedrick | 226/127 X |

FOREIGN PATENTS OR APPLICATIONS

| | | | |
|---|---|---|---|
| 649,551 | 11/1962 | Italy | 4/67 R |

*Primary Examiner*—Richard E. Aegerter
*Assistant Examiner*—Stuart S. Levy
*Attorney, Agent, or Firm*—Arnstein, Gluck, Weitzenfeld & Minow

[57] ABSTRACT

A water closet flush valve actuator which constitutes a part of the cover for the flush tank and which blends into the surface contour of the cover so that in non-operative position the actuator appears as an integral part of the cover.

4 Claims, 9 Drawing Figures

ACTUATING MEANS FOR WATER CLOSET FLUSH TANK

BACKGROUND OF THE INVENTION

This invention relates to means for actuating the flush tank mechanism for a water closet.

Conventionally, the means commonly employed for controlling the flushing of flush tanks comprises a pivotally mounted handle or lever for actuating the flush valve. These handles are mounted exteriorly of the flush tank and are operatively connected to the flush valve. There has always been a demand for something novel and more aesthetically appealing than the conventional lever. As a result, many attempts have been made to depart from the use of conventional handles for operating the flush valve. One such departure is the use of a push button, as exemplified in U.S. Pat. No. 3,561,015.

SUMMARY OF THE INVENTION

It is an object of the present invention to provide a novel flush valve control which utilizes a portion of the tank cover as the actuating means, thereby eliminating the use of any conventional exteriorly disposed levers or push buttons which project in a manner that can be hazardous to the user.

Another object of this invention is the provision of a novel flush valve control which blends into the surface configuration of the cover of the flush tank thereby enhancing its aesthetic appearance.

Still a further object of this invention is the provision of novel flush valve control of the foregoing type which may be incorporated in an injection molded tank of suitable plastic material thereby effecting economies and simplification in fabrication.

Other and further objects and advantages of this invention will become apparent from the following description when considered in connection with the accompanying drawings.

BRIEF DESCRIPTION OF A PREFERRED EMBODIMENT

Figure 1:
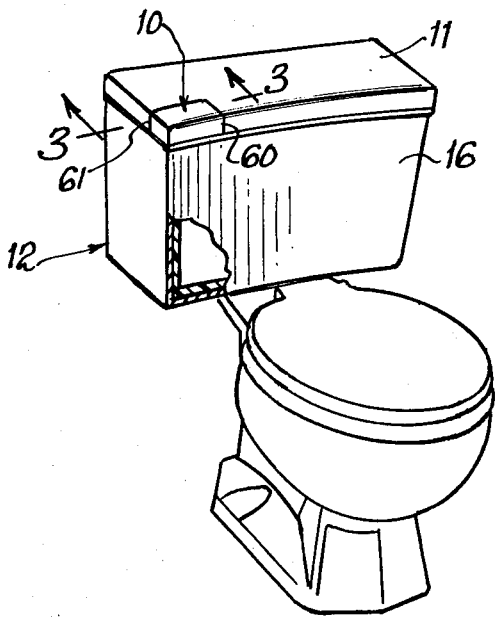
FIG. 1 is a perspective view of a flush tank and showing the novel flush valve control, in accordance with my invention.

Referring first to FIG. 1, the actuating means 10 of my invention is shown as part of a cover 11 which surmounts a flush tank 12 provided with a flapper valve 13 controlling the opening and closing of the discharge outlet 14. Both the tank and cover preferably are formed by injection molding of suitable plastic material and are lightweight and shatter proof.

Figure 9:
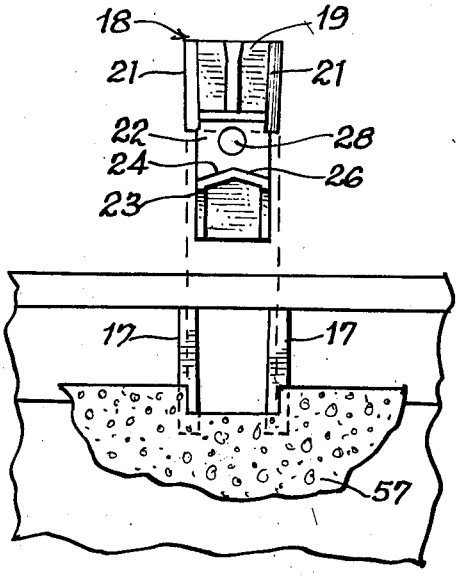
FIG. 9 is a fragmentary elevational view of structural details in exploded relation.

The tank 12 is provided on the inner surface of the front wall 16 with a pair of integral undercut guide member 17 extending vertically and in close proximity to the forward left hand corner of the tank, as viewed in FIG. 1. A bracket 18 includes an upper portion 19 having beveled side edges 21, an integral intermediate lateral portion 22 and a depending offset portion 23 having laterally extending angular faces 24 and 26 sloping in opposite directions, as seen clearly in FIG. 9.

Figure 3:
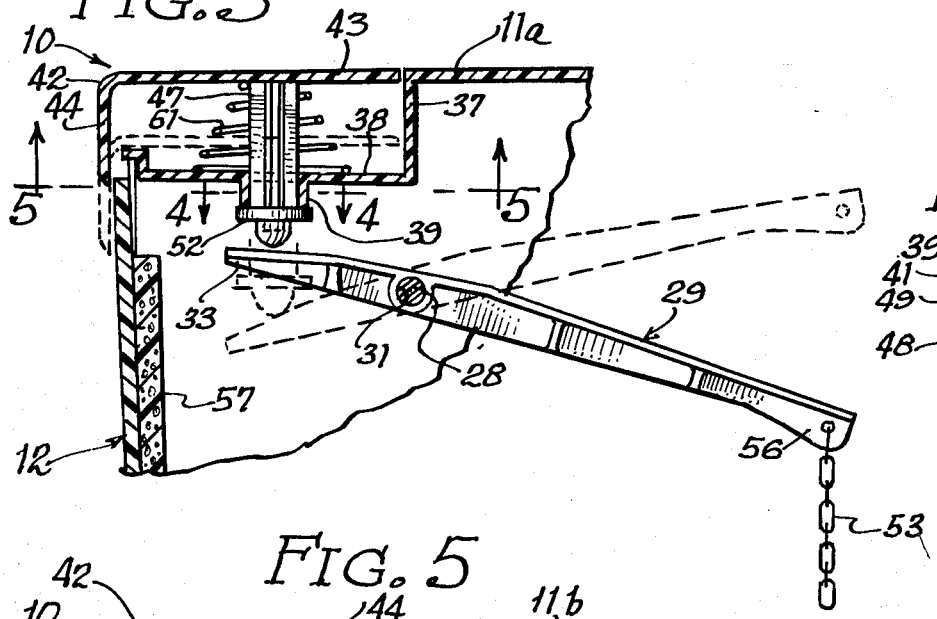
FIG. 3 is a fragmentary cross-sectional view, on an enlarged scale, taken substantially on line 3—3 of FIG. 1.
Figure 6:
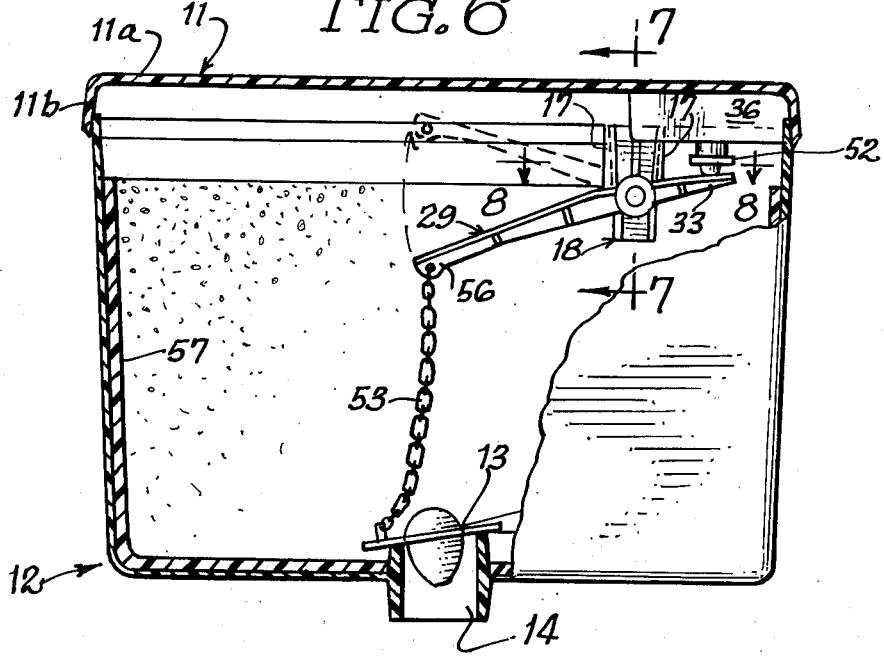
FIG. 6 is a longitudinal cross-sectional view of a flush tank, partly in elevation, embodying my invention.
Figure 7:
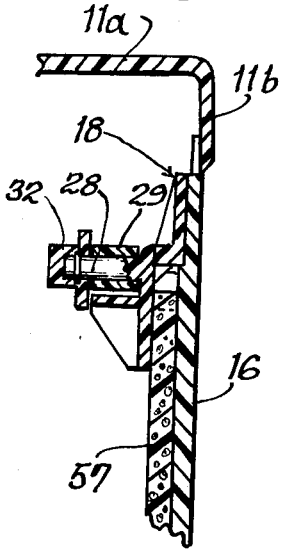
FIG. 7 is a fragmentary cross-sectional view, on an enlarged scale, taken substantially on line 7—7 of FIG. 6.
Figure 8:
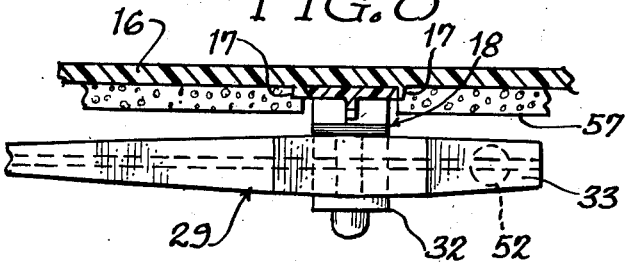
FIG. 8 is a fragmentary cross-sectional view, on an enlarged scale, taken substantially on line 8—8 of FIG. 6.

A stub shaft 28 extends laterally from the depending offset portion 23 above the juncture of the angular faces 24 and 26. A lever 29 shaped substantially as illustrated in FIG. 3 includes a transverse bore 31 constituting a bearing in which the shaft 28 is received. A cap 32 fixed on the end of the shaft 28 retains the lever 29 on the shaft. As seen clearly in FIG. 7, the bracket 18 is mounted on the forward wall 16 of the tank by sliding the beveled edges 21 into engagement with the undercut guide members 17. In such assembled relationship, as seen in FIGS. 3 and 6, the distal end 33 of the lever 29 is located in close proximity to a corner of the tank 12 in position to be engaged by the actuating means 10, presently to be described.

Figure 2:
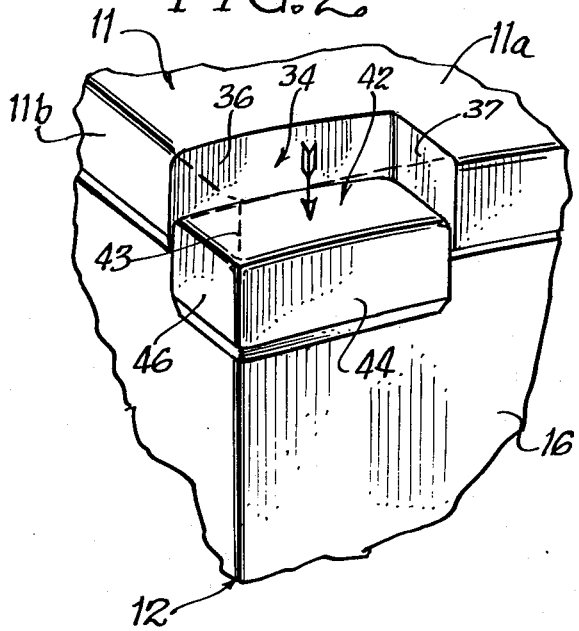
FIG. 2 is a fragmentary perspective view, on an enlarged scale, showing the flush valve control, in accordance with my invention.
Figure 5:
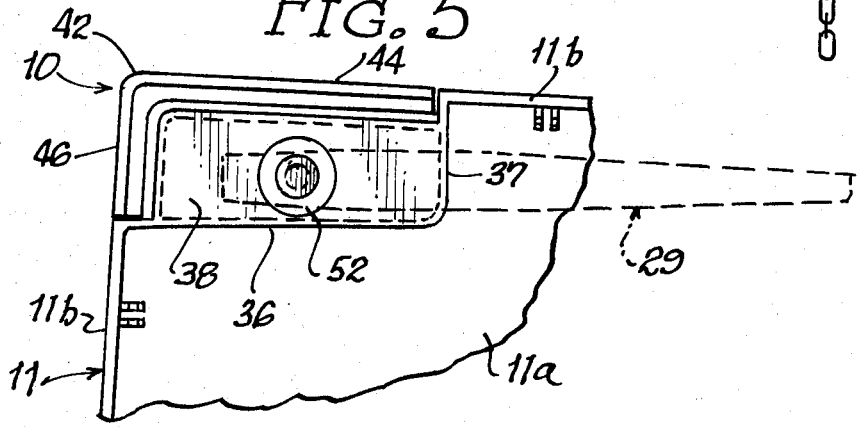
FIG. 5 is a cross-sectional view taken substantially on line 5—5 of FIG. 3.

Referring to FIGS. 2, 3 and 5, the cover 11 includes a top wall 11*a* and a peripheral depending flange 11*b*. As viewed in FIGS. 1 and 2, a recess 34 is provided in the forward left hand portion of the cover 11. Said recess is generally rectangular in plan and is delineated by integral side walls 36 and 37 and a bottom wall 38. The bottom wall 38 includes a centrally located depending hollow boss 39, the inner surface of which is provided with inwardly extending circumferentially spaced integral lugs 41.

Figure 4:
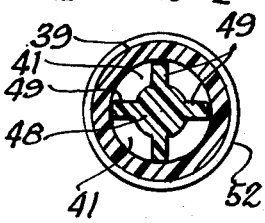
FIG. 4 is a cross-sectional view, on an enlarged scale, taken substantially on line 4—4 of FIG. 3.

The actuating means 10 comprises a molded member 42 having integral top, side and forward walls 43, 44 and 46, respectively. Depending from the underside of the top wall 43, is a stem 47 shaped in cross-section substantially as illustrated in FIG. 4, with a central core 48 and integral radially directed ribs 49. The stem 47 is received in the bore of the boss 39 with the ribs 49 disposed in the spaces between the lugs 41 and is axially slidable but not rotatable relative to the boss 39. A coil spring 51 is circumposed about the stem 47 with its opposite ends abutting the walls 38 and 43. The spring 51 normally biases the member 42 upwardly to the non-operating position illustrated in FIGS. 1 and 3. Fixed to the lower end of the stem 47 is a cap 52 which retains the stem 47 is assembled relation and which engages one end 33 of the lever 29. A chain 53 is connected to the opposite end 56 of lever 29 and to flapper valve 13.

The tank 16 is provided with an insulating liner 57 preferably formed of molded Styrofoam. The liner 57 is contiguous to and coextensive with substantially the entire inner surface areas of the tank 16, it being understood that openings are provided in the liner to accommodate the conventional fittings for the discharge outlet, inlet supply and overflow discharge of the flush tank. The provision of the liner prevents "sweating" of the tank during humid weather conditons.

In normal out of use position, the actuating means 10 assumes the position illustrated in FIGS. 1, 3 and 6 wherein the top wall 43 is substantially co-planar with the wall 11*a* of the cover 11 and, correspondingly, walls 44 and 46 are co-planar with respective front and side flanges 11*b* of the cover. Thus, except for the breaks in the surfaces at lines 60 and 61, the surfaces of the cover 11 are substantially uninterrupted and present the effect of surface continuity.

In operation, the user merely momentarily depresses the member 42 to its lower limit to the position illustrated by the solid lines in FIG. 2. In such position, the lever 29 has been rocked to the broken line position shown in FIGS. 3 and 6 to draw the flapper valve 13 upwardly to effect opening of the discharge outlet 14. Upon removal of pressure, the member 42 is caused to return to normal to non-operating position by spring 51. The length of the arm portion of lever 29, extending the left of the fulcrum or shaft 28, as viewed in FIG. 3, affords a mechanical advantage. Accordingly, it has been found that with the use of the present invention, substantially less force is required to effect a flushing operation than by the use of conventional lever operated means.

It will be understood that the actuating means of my invention may be disposed at locations on the cover other than that shown in the drawings.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In combination, a flush tank having a discharge outlet and a flush valve controlling said discharge outlet, a lever pivoted intermediate its ends to a wall of said tank, means connecting one end of said lever to said flush valve, a removable cover for said tank, said cover including a top wall and a depending peripheral flange, said cover having a recess of substantial area in said top wall at a corner thereof, said recess being defined by vertical and bottom wall portions with the bottom wall portion having an aperture therein, an actuating member of similar substantial area movable in said recess, said actuating member including a depending stem slidable in said aperture, the lower end of said stem engaging the other end of said lever, the outer surfaces of said actuating member when said member is disposed in non-operating position being substantially co-planar with corresponding adjacent outer surfaces of said top wall and depending flange and means for biasing said actuating member to non-operating position.

2. In combination, a flush tank having a discharge outlet and a flush valve controlling said discharge outlet, a pair of spaced guide members carried on a wall of said tank, a bracket supported by said guide members and including a horizontal shaft, a lever rockably supported intermediate its ends on said shaft, means connecting one end of said lever to said flush valve, a removable cover for said tank, said cover including a top wall and a depending peripheral flange, said cover having a recess of substantial area in said top wall at a corner thereof, said recess being defined by vertical and bottom wall portions with the bottom wall portion having an aperture therein, an actuating member of similar substantial area movable in said recess, said actuating member including a depending stem slidable in said aperture, the lower end of said stem engaging the other end of said lever, the outer surfaces of said actuating member when said member is disposed in non-operating position being substantially co-planar with corresponding adjacent outer surfaces of said top wall and depending flange and means for biasing said actuating member to non-operating position.

3. The invention as defined in claim 1 including means for keying said stem in said aperture to prevent relative angular movement but permitting relative axial movement.

4. The invention as defined in claim 2 including means for keying said stem in said aperture to prevent relative angular movement but permitting relative axial movement.

* * * * *